United States Patent [19]

Neff

[11] 4,078,702

[45] Mar. 14, 1978

[54] AUTOMATICALLY RE-CLOSING A CLOSURE DIFFICULT FOR CHILDREN TO OPEN

[75] Inventor: David Warren Neff, West Chester, Pa.

[73] Assignee: Pennwalt Corporation, Philadelphia, Pa.

[21] Appl. No.: 732,279

[22] Filed: Oct. 14, 1976

[51] Int. Cl.[2] ..... B65D 47/20

[52] U.S. Cl. ..... 222/182; 222/517; 222/557

[58] Field of Search ..... 222/173, 182, 517, 557

[56] References Cited

U.S. PATENT DOCUMENTS

| | | | |
|---|---|---|---|
| 65,430 | 6/1867 | Putnam | 222/557 |
| 1,133,134 | 3/1915 | Gruettner | 222/517 |
| 1,145,139 | 7/1915 | Henderson | 222/517 X |
| 1,588,675 | 6/1926 | Gove | 222/557 X |
| 1,733,106 | 10/1929 | Cannon | 222/182 X |
| 2,302,972 | 11/1942 | Nuckols | 222/557 X |
| 3,140,020 | 7/1964 | Spier | 222/517 |

*Primary Examiner*—Robert B. Reeves
*Assistant Examiner*—Frederick R. Handren
*Attorney, Agent, or Firm*—Charles N. Quinn

[57] ABSTRACT

This invention relates to automatic closures of the type in which finger pressure applied to a portion of the closure opens an aperture of a container to which the closure is attached thereby permitting dispensing of granular material from the container. Upon release of finger pressure, the closure self-closes, preventing accidental dispensing of material from the container.

11 Claims, 17 Drawing Figures

AUTOMATICALLY RE-CLOSING A CLOSURE DIFFICULT FOR CHILDREN TO OPEN

BACKGROUND AND DESCRIPTION OF THE PRIOR ART

Automatic closures are known; two are disclosed in U.S. Pat. Nos. 3,425,578 and 3,561,591. The closures disclosed therein have a plurality of moveable parts and are expensive to manufacture. As a further disadvantage those closures are prone to stick in the open position when granular material is dispensed, due to the type of motion involved as the closure attempts to automatically close. Moreover, those closures do not open with a measured level of difficulty. This makes them easily openable by children and unsuitable for containers of caustic or poisonous material.

Many "child-proof" containers for caustic or poisonous material are known but none incorporate self-closing features. Such containers may be child-proof in the sense that the containers are difficult to open; however, once the containers are open, they remain so and nothing denies children access to their contents.

SUMMARY OF THE INVENTION

The present invention provides an automatic closure which is substantially child-proof due to (1) the dexterity required to open the closure and (2) a sight shield which makes it difficult for a child to envision the opening-closing function of the closure. The closure is less complex than known automatic closures and may be manufactured by injection molding a single piece of resilient plastic. A portion of the closure lies flat over the container dispensing aperture. The flat portion moves slidably along the surface of the container lid to close the container; this sliding movement minimizes the possibility of a stray particle of dispensed granular material maintaining the closure in the open position.

Figure 1:
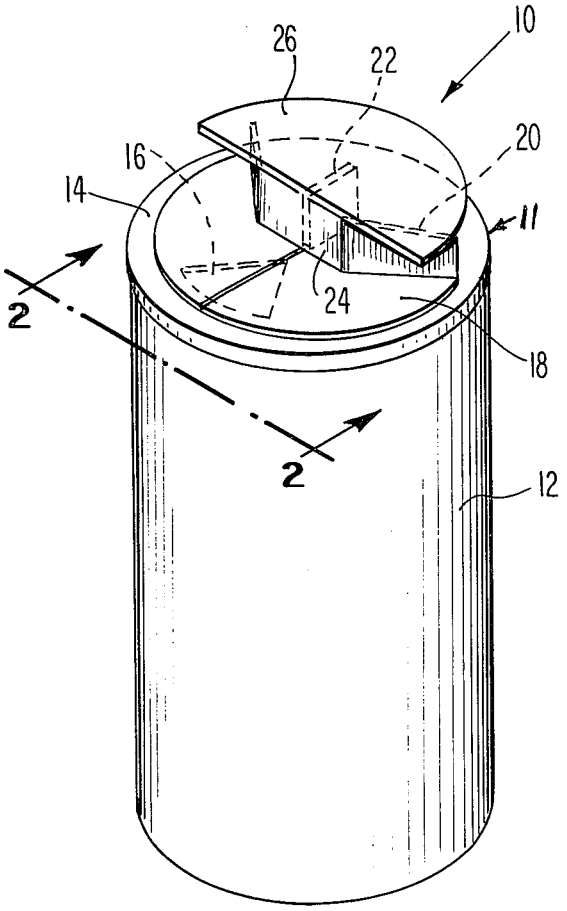
FIG. 1 is an isometric view of a dispensing container with the preferred embodiment of the closure of the present invention attached thereto. The closure is illustrated in the closed position.

In the drawings lower case letters denote parts having similar names and functions in different embodiments of the invention.

DESCRIPTION OF THE PREFERRED EMBODIMENTS

Referring to FIG. 1, a closure, generally denoted 10 is affixed to a flat deck 14 of a lid 11 of a container 12. The closure may be affixed to the lid using any conventional means, such as adhesives, or may be injection molded as an integral portion thereof. The means for affixing the closure to the lid does not form part of the invention. Lid 11 covers a dispensing mouth portion of container 12 with flat deck 14 having an aperture 16 therethrough for dispensing granular material from container 12. Closure 10 includes an upstanding rib 22 extending generally perpendicularly from flat deck 14 with a bias means 24 extending outwardly from rib 22 and connecting a gripping means 20 with a flap means 18. Gripping means 20 is displaceable, from the illustrated initial position, in response to finger pressure; flap means 18 is moveable unitarily therewith. Flap means 18 closes aperture 16 and is slideable along flat deck 14 between a first position, illustrated in FIG. 1 wherein aperture 16 is closed, and a continuum of second positions within which aperture 16 is open.

Bias means 24 is formed from a material having a "memory" characteristic. Suitable materials include polyamides such as nylon, polyesters, polyacrylics, cellulose acetate, and synthetic rubbers such as Kraton and Telcar. Upon displacement of gripping means 20 from the initial position illustrated in FIG. 1, at which flap means 18 closes aperture 16, the memory characteristic of bias means 24 urges gripping means 20 to return to the initial position thereby returning flap means 18 to the first position at which aperture 16 is closed.

A sight shield 26, preferably affixed to container 12 via rib 22, makes is difficult for a child (1) to visualize application of finger pressure to gripping means 20 to open aperture 16 and (2) to position his fingers on gripping means 20 between sight shield 26 and deck 14 to apply finger pressure to open the container.

Figure 2:
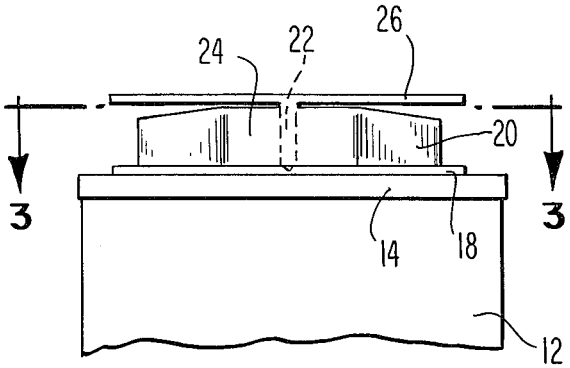
FIG. 2 is a partial front sectional view taken along line 2—2 in FIG. 1.

Referring to FIG. 2, gripping means 20 and bias means 24 all mounted for movement beneath sight shield 26. As gripping means 20 is displaced from the initial position, gripping means 20 and bias means 24 slide along deck 14 beneath sight shield 26 with bias means 24 rotating about rib 22. In the embodiment illustrated in FIGS. 1 through 5, connection of gripping means 20 to flap means 18 assures that the flat means and gripping means move unitarily.

Figure 3:
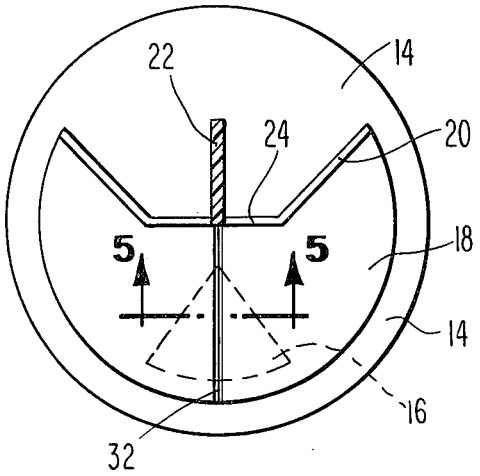
FIG. 3 is a top sectional view taken along line 3—3 in FIG. 2.
Figure 4:
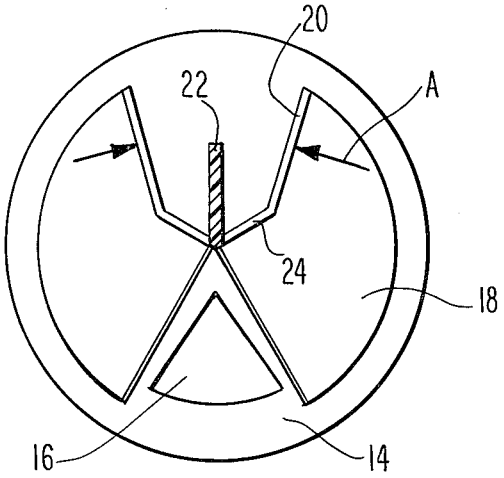
FIG. 4 is a top sectional view taken along line 3—3 in FIG. 2, but with the closure in the open position.

In FIG. 3 the closure is shown with the two flaps of flap means 18 abutting along a mating line 32 thereby closing aperture 16. When finger pressure is applied to gripping means 20, as illustrated by arrow A in FIG. 4, the two halves of gripping means 20 are forced towards each other and the two flaps of flap means 18 separate along line 32 with a scissors-like action thereby opening dispensing aperture 16, as shown in FIG. 4. Once finger pressure has displaced gripping means 20 from its initial position, and flap means 18 has opened aperture 16, flap means 18 is said to have been displaced from the first position to within a continuum of second positions within which aperture 16 is at least partially open.

Figure 5:
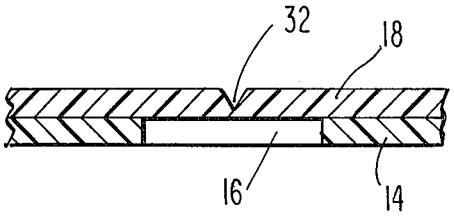
FIG. 5 is a partial sectional view of the closure taken along line 5—5 in FIG. 3.

In FIG. 5, it is seen that flap means 18 is flush with deck 14 thereby preventing lodging of dispensed particles between flap means 18 and flat deck 14.

Figure 6:
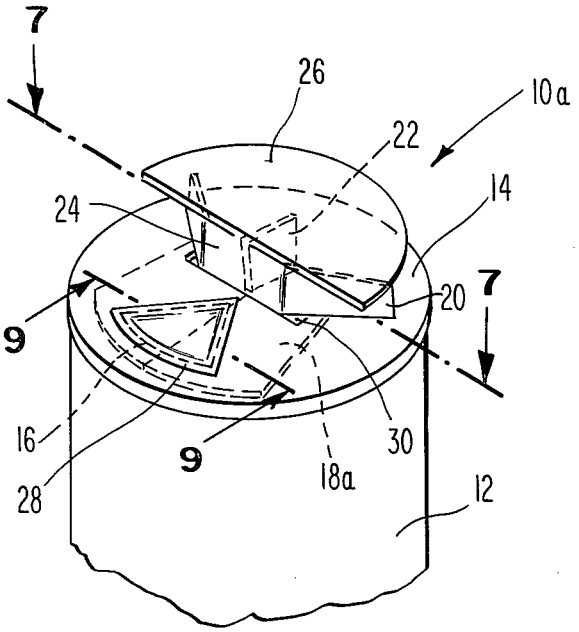
FIG. 6 is an isometric view of a second embodiment of the closure of the present invention attached to a dispensing container. The closure is illustrated in the closed position.

In FIG. 6 a second embodiment of the closure is illustrated in the closed position. In the second embodiment flap means 18*a* moves slideably along and underneath flat deck 14, within container 12. A second aperture 30 is in lid 11 for connection of flap means 18*a* with bias means 24, allowing flap means 18*a* to move with gripping means 20. A flap peel strip 28 is provided for sealingly closing aperture 16. The flap peel strip prevents spillage of the contents of container 12 during shipment and is removed by the purchaser of the container. Once removed, pellicular peel strip 28 is discarded.

Figure 7:
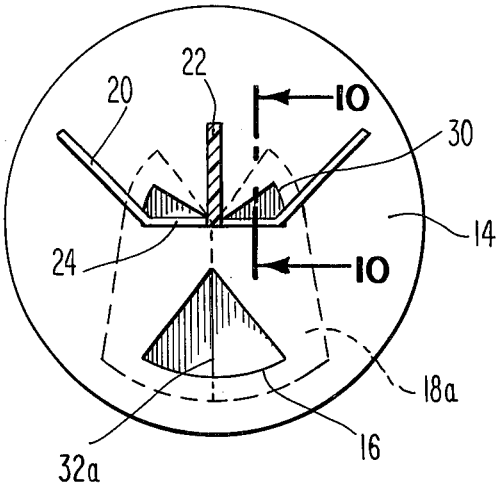
FIG. 7 is a top sectional view taken along line 7—7 in FIG. 6.
Figure 8:
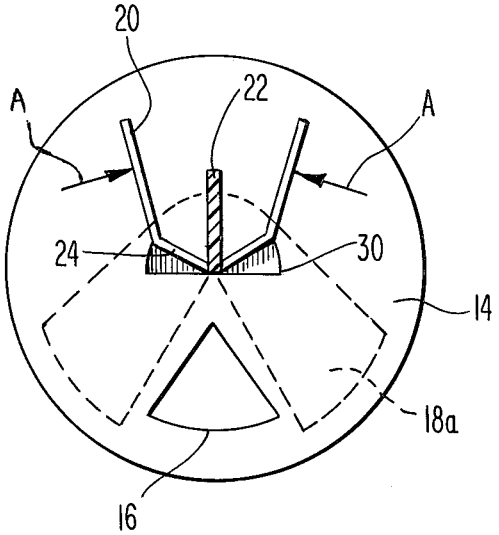
FIG. 8 is a top sectional view taken along line 7—7 in FIG. 6, but with the closure in the open position.

In FIG. 7, two flaps of flap means 18*a* are shown adjoining along mating line 32*a*, thereby closing aperture 16. The position of flap means 18*a* in the closed position is shown by the dotted line. Upon application of finger pressure to gripping means 20, as denoted by arrows A in FIG. 8, the two flaps separate along mating line 23*a*, moving to within the continuum of second positions within which dispensing aperture 16 is at least partially open. Second aperture 30 is of size that it is always closed by flap means 18*a* so no material in container 12 can escape therethrough. The position of flap means 18*a* when the container is fully open is shown by the dotted line in FIG. 8.

Figure 9:
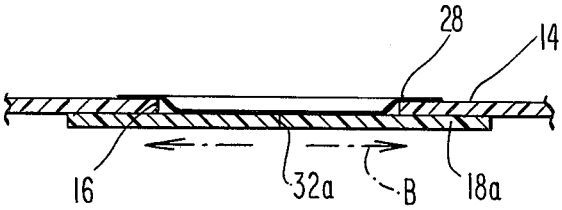
FIG. 9 is a partial front sectional view taken along line 9—9 in FIG. 6.

In FIG. 9 arrow B denotes movement of the two flaps of flap means 18*a*, as the two flaps move slideably underneath flat deck 14.

Figure 10:
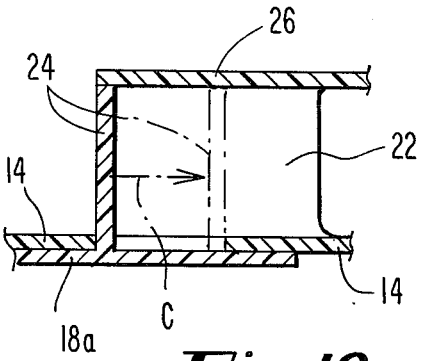
FIG. 10 is a partial side sectional view taken along line 10—10 in FIG. 7.
Figure 11:
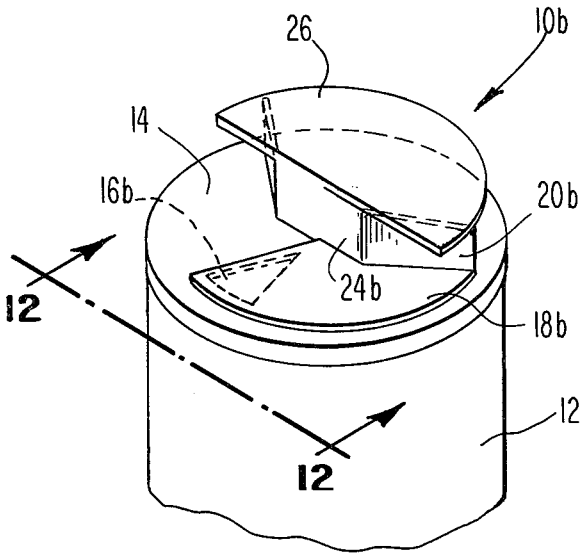
FIG. 11 is an isometric view of a third embodiment of the closure of the present invention attached to a dispensing container. The closure is illustrated in the closed position.

In FIG. 10 movement of the bias means 24 and flap means 18*a* is illustrated. In the absence of finger pressure on gripping means 20, bias means 24 and flap means 18*a* are in the position shown in sectional lines in FIG. 10. Upon application of finger pressure to gripping means 20 as indicated by arrow A in FIG. 8, bias means 24 moves, as denoted by arrow C in FIG. 10, to the position shown in phantom lines in FIG. 10. This rotates flap means 18*a* about upstanding rib 22 thereby opening aperture 16.

Figure 12:
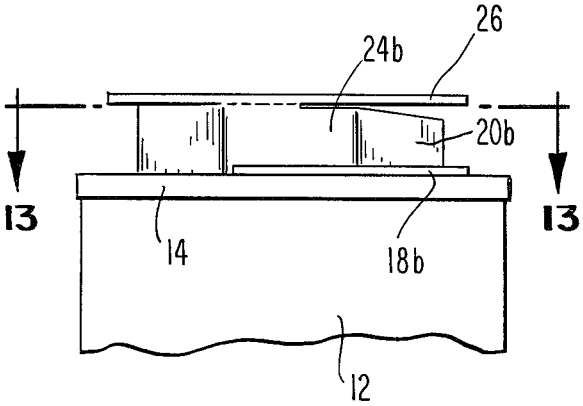
FIG. 12 is a partial front sectional view taken along line 12—12 in FIG. 11.
Figure 14:
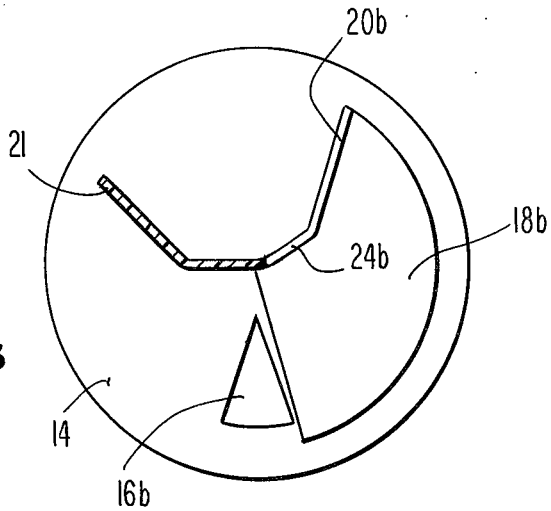
FIG. 14 is a top sectional view taken along line 13—13 in FIG. 12, but with the closure in the open position.
Figure 15:
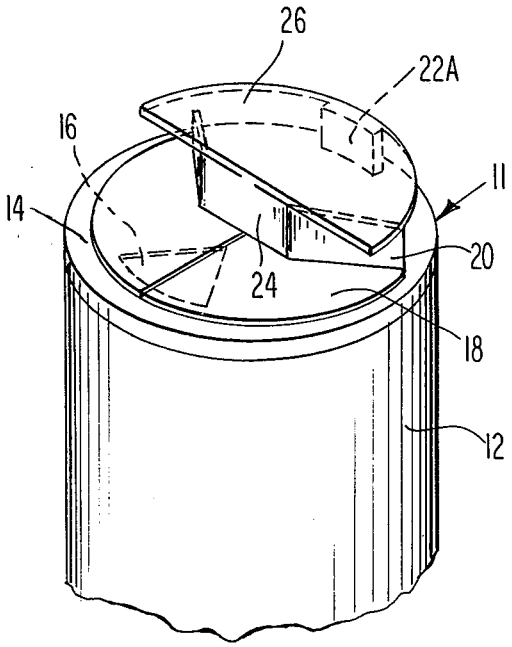
FIG. 15 is an isometric view of the closure of the invention where the sight shield has been mounted along a vertical edge of the container.
Figure 16:
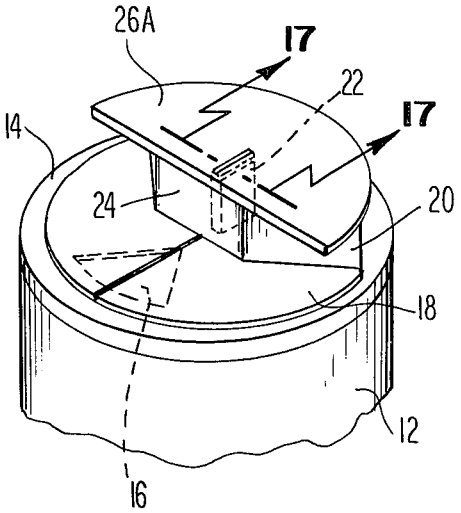
FIG. 16 is an isometric view of the closure of the invention where the sight shield is removably mounted on the container.
Figure 17:
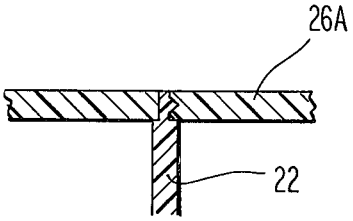
FIG. 17 is a fragmentary sectional view taken at arrow 17—17 in FIG. 16.

In the third embodiment of the closure, illustrated in FIGS. 11 through 14, flap means 18*b* consists of but a single flap; no scissors-like action of two flaps is involved in the opening-closing function. In the third embodiment flap means 18*b* moves slideably along flat deck 14, over the exterior surface thereof. The flap is flush with flat deck 14 as shown in FIG. 12. Aperture 16*b* is sufficiently small to be completely covered by flap means 18*b* when flap means 18*b* is in the disposition shown, closing the container. In the third embodiment the gripping means consists of a moveable portion designated 20*b*, extending upward from flap means 18*b*, and a fixed portion 21 extending upward from lid 11. Flap means 18*b* is connected to bias means 24*b*. Flap means 18*b* moves slideably over deck 14, with the motion being rotation about the connection of bias means 24*b* and deck 14. Sight shield 26*b* is connected to and supported by gripping means fixed portion 21.

Figure 13:
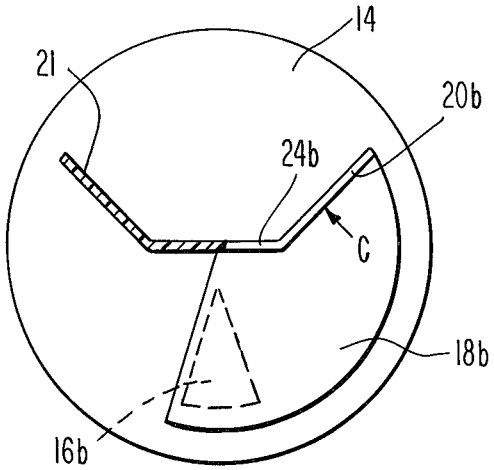
FIG. 13 is a top sectional view taken along line 13—13 in FIG. 12.

The third embodiment of the closure is opened by applying finger pressure to gripping means moveable portion 20*b* in the direction shown by arrow C in FIG. 13. The fingers or thumb not pressed against gripping means moveable portion 20*b* are braced against fixed portion 21, or against container 12. Upon application of finger pressure to moveable portion 20*b*, flap means 18*b* rotates while bias means 24*b* resists such rotation and continuously urges flap means 18*b* to return to the position illustrated in FIGS. 12 and 13 whereat the container is closed. Continued application of finger pressure of sufficient magnitude to gripping means moveable portion 20*b* causes flap means 18*b* to move to the position illustrated in FIG. 14, wherein aperture 16*b* is completely open. Upon release of finger pressure the memory characteristic of bias means 24*b* causes gripping means moveable portion 20*b* and flap means 18*b* to rotate clockwise, opposite to arrow C in FIG. 13, closing aperture 16.

The closure is preferably a single injection molded piece of resilient plastic. The closure may also be fabricated from two or more pieces of material with the pieces joined after molding. The sight shield may be connected to and supported by container 12 or lid 11, as an alternative to the illustrated structures.

Variations, including reversals of parts from those shown and other modifications fall within the scope of this invention. The above particular description is by way of illustration and not of limitation. Changes, ommissions, additions, substitutions, and/or modifications may be made without departing from the spirit of the invention. Accordingly, it is intended that the patent should cover, by suitable expression in the claims, the various features of patentable novelty that reside in the invention.

Having thus described my invention, I claim the following:

1. In a container having a lid with a flat deck portion and a dispensing aperture within said deck, an improved closure comprising:

a. flap means for covering said aperture, pivotally connected to said deck and disposed flush therewith for sliding movement thereover about said pivotal connection, moveable between a first position at which said aperture is covered and a second position at which said aperture is exposed.

b. means, cantilevered from said deck, for biasing said pellicular means towards said first position;

c. gripping means extending from said flap means to facilitate application of finger pressure to move said flap means, against bias exerted by said bias means, from said first position towards said second position; and d. a sight shield over said gripping means, mounted upon said container, spaced from said deck to allow application of finger pressure to said gripping means.

2. The improved closure of claim 1 wherein said sight shield does not cover said aperture.

3. The improved closure of claim 1 wherein said bias means is stress-free when said flap means is at said first position.

4. The improved closure of claim 1 wherein said flap means consists of two flaps which mate over said aperture in said first position and which pivot in opposite direction about said bias means, in a scissor-like action, to expose said aperture, in response to finger pressure applied to said gripping means.

5. The improved closure of claim 1 wherein said flap means consists of a single flap which covers said aperture in said first position and which pivots about said bias means to expose said aperture in response to finger pressure applied to said gripping means.

6. The improved closure of claim 1 wherein said flap means, said bias means and said gripping means are of unitary plastic construction.

7. The improved closure of claim 1 wherein said sight shield is mounted to said bias means.

8. The improved closure of claim 1 wherein said flap means, said bias means, said gripping means and said sight shield are of unitary plastic construction.

9. The improved closure of claim 1 wherein said sight shield is mounted along a vertical edge of said container.

10. The improved closure of claim 1 wherein said sight shield is removably mounted.

11. The improved closure of claim 5 wherein said gripping means consists of a moveable portion extending upward from said flap and a fixed portion extending upward from said lid.

* * * * *